United States Patent [19]

Strike

[11] 4,019,440

[45] Apr. 26, 1977

[54] IMPACT DISCRIMINATING APPARATUS FOR MISSILES AND THE LIKE, AND METHOD FOR IMPACT DISCRIMINATION

[75] Inventor: Robert Strike, Pomona, Calif.

[73] Assignee: General Dynamics, Pomona Division, Pomona, Calif.

[22] Filed: July 10, 1975

[21] Appl. No.: 594,903

[52] U.S. Cl. ..... 102/70.2 R; 102/70.2 GA

[51] Int. Cl.[2] ..... F42C 11/00

[58] Field of Search ..... 102/70.2 GA, 70.2 R, 102/73 R, 70.2 P; 280/735; 310/8.7

[56] References Cited

UNITED STATES PATENTS

| | | | |
|---|---|---|---|
| 3,135,206 | 6/1964 | Hjelm et al. | 102/73 R |
| 3,653,324 | 4/1972 | Furlani | 102/70.2 R |
| 3,701,903 | 10/1972 | Merhar | 102/70.2 GA X |
| 3,750,583 | 8/1973 | While et al. | 102/70.2 R |
| 3,786,758 | 1/1974 | Zimmerman | 102/70.2 R |
| 3,926,120 | 12/1975 | Williams et al. | 102/70.2 GA X |

*Primary Examiner*—David H. Brown
*Attorney, Agent, or Firm*—Henry M. Bissell; Edward B. Johnson

[57] ABSTRACT

Impact discriminating apparatus for missiles and the like comprises a plurality of impact sensors disposed in spaced relationship along the longitudinal axis, and near the nose, of the missile. Sensors, responsive to elastic domain impact stress or shock waves, are separately fed into pulse generators wherein output pulses of different widths are formed for each sensor, overlapping pulses associated with all the sensors being generated for rearwardly propagated shock waves caused by a direct hit, but not for forwardly propagated shock waves caused, for example, by a stabilizer fin striking tree branches or other non-target objects. The generated pulses are fed to a NAND gate which is activated to cause fusing or detonation of the missile only by the overlapping pulses respresentative of a direct hit. Blanking circuitry blanks out effects of rearwardly propagated shock waves which are merely reflections of forwardly propagated shock waves, in order to prevent unintentional fusing or detonation. Pulse height discrimination is also provided to prevent unintentional fusing or detonation by low impact direct contact with such objects as foliage or raindrops or by low impact, glancing hits against tree branches and the like. A corresponding impact discrimination method is provided.

13 Claims, 5 Drawing Figures

IMPACT DISCRIMINATING APPARATUS FOR MISSILES AND THE LIKE, AND METHOD FOR IMPACT DISCRIMINATION

BACKGROUND OF THE INVENTION

1. Field of the Invention

The present invention relates to the field of impact responsive actuating apparatus; more particularly, it relates to such apparatus in missiles having impact discrimination to prevent unintended detonation or fusing.

2. Description of the Prior Art

A problem with explosive missiles, such as rockets and re-entry vehicles, mortar or artillery shells, is unintended and premature detonation which may cause injury to friendly troops and objects. Such premature detonation may be caused by pre-launch damage to the missile, by launching stresses, or by the missile impacing an intervening object before reaching the target.

Premature detonation problems associated with prelaunch damage and launching stresses are normally solved by maintaining the missile in an unarmed condition until after the launch has been completed. White, et al. (U.S. Pat. No. 3,750,583) and Furlani, et al. (U.S. Pat. No. 3,653,324), for example, disclose arming apparatus. Launch accelerations perform the arming in the apparatus of White, et al. The apparatus of Furlani, et al, additionally examines the "launch signatures", that is, the various launch stresses, and arms the missile only if all of such "signatures" fall within predetermined limits. Missiles upon which such or similar apparatus are installed are not armed until they have been properly launched. Danger of premature detonation caused by pre-launch damage and launch stresses is thereby minimized.

Assuming, however, that a missile is provided with an appropriate arming apparatus, a substantial problem still exists relative to premature detonation caused by the missile impacting intervening objects before reaching the intended target. Such intervening objects may include tree branches, leaves, undergrowth, raindrops, airborne ice crystals and airborne materials such as sand and debris from prior explosions.

If the intended target is very hard, like concrete, steel or hard earth, an impact fuse or detonator responsive only to a high impact force may be used to prevent premature detonation caused by lesser impacts with the types of intervening objects mentioned above. However, if the intended target is itself comparatively soft, such as swampy ground or water, impact discrimination is less easily accomplished; if too hard an impact is required for detonation, in an attempt to provide impact discrimination, detonation may not occur when the target is hit.

Zimmerman (U.S. Pat. No. 3,786,758) and Cummings (U.S. Pat. No. 3,805,703) disclose apparatus for discriminating between impact with the intended target and impact with intervening objects. Zimmerman discloses a plurality of series connected impact sensors or "switches" positioned around the outside of the missile nose. Detonation of the missile occurs only when all switches are simultaneously activated, it being assumed that intervening objects (specifically raindrops in the disclosure) will be randomly distributed so that all of the switches will not be impacted at the same time until the target itself is impacted. However, an inordinately large number of sensors is required to insure that all will not be simultaneously impacted under very heavy rain conditions. This adds to system complexity and cost, and introduces reliability problems.

Cummings disclosed an electronic integrating comparator which detonates the missile only when the impact time duration exceeds a predetermined time duration. It was noted that the impact time for tree branches and other material, referred to collectively as "canopy", is comparatively short compared to that of impact with a hard target (before the sensors are impact damaged). If, however, comparatively unyielding obstacles, such as large tree limbs, are impacted, the predetermined impact duration may be exceeded and premature detonation may result.

Fohrmann, et al. (U.S. Pat. No. 3,440,961) and Bliss (U.S. Pat. No. 3,158,705) disclose plural impact sensors connected in parallel to insure missile detonation upon impact with any of the sensors, rather than to provide impact discrimination.

For the reasons set forth above, and others, additional improvements in the field of impact discrimination are still required.

SUMMARY OF THE INVENTION

An impact discriminating apparatus, in accordance with the invention, comprises a plurality of impact sensors disposed in a movable object in spaced relationship along a predetermined line of impact, and electronic comparing means cooperating with the sensors and with a function performing means within the object to cause operation of the function performing means only when electrical outputs of the sensors indicate occurrence of an impact in a predetermined direction along the predetermined line of impact.

More specifically, the comparing means includes a pulse generator associated with each of the sensors for causing a generator output pulse in response to sensor output signals. The width of the pulses from each generator is caused to vary according to spacing of the associated impact sensor from a predetermined, intended impact point. The width of pulses associated with sensors close to the intended impact point are greater than the pulse widths of pulses associated with sensors positioned more remotely from such impact point, so that a shock front propagating through the object away from the intended impact point, and along the predetermined line of impact, causes overlapping pulses from each of the pulse generators, and so that a shock front caused by a rear impact and propagating through the object towards the intended impact point, along the predetermined line of impact, does not cause overlapping pulses from all pulse generators.

The comparing means includes a gating element, to inputs of which the pulse generator pulses are fed. The output of the gating element is initially at a first level not causing operation of the function performing means — which may be a missile fusing or detonating element. When overlapping pulses from each pulse generator are received, the gatingelement output changes gating element and the function performing means is caused to be operated.

To prevent the unintended operation of the function performing means by shock waves rearwardly reflected through the object from the intended impact point (caused by shock waves propagated toward such impact point), the comparing means includes blanking means which blank out or disregard second sensor output signals received within a predetermined time after receipt of the first output signals from any sensor. Thus, only the effect of the primary shock front is "considered" by the comparing means. Further, pulse height discrimination is provided to reject sensor signals below a predetermined level, regardless of the direction of the impact shock wave, thereby causing the apparatus not to respond to impact shocks below a predetermined level.

A corresponding method for impact discrimination is thereby provided.

Use of such apparatus in a missile prevents premature fusing or detonation thereof by impact of, for example, stabilizing fins against high impact objects, such as large tree limbs, intermediate the launch position and the target, and which cause propagation of shock waves in a substantially different direction from a shock wave propagated by a direct hit by the missile nose cone. Premature fusing or detonation of the missile by low impact direct or glancing hits is prevented by rejecting low level sensor outputs, irrespective of direction of shock front propagation. By adding more sensors, or by positioning sensors along different axes, substantially any desired degree of impact discrimination can easily and effectively be provided.

BRIEF DESCRIPTION OF THE DRAWING

A better understanding of the present invention may be had from a consideration of the following detailed description taken in conjunction with the accompanying drawing, in which.

DESCRIPTION OF THE PREFERRED EMBODIMENT

Little impact discrimination can be provided if the nose cone impact portion of a missile squarely strikes an intervening object, such as a large tree trunk, which has an impact resistance about equal to that of the intended target. Since the intervening object "looks" like the target to the impact sensors, the warhead will be fused or detonated. However, even comparatively large intervening objects are more likely to be struck by outwardly protruding missile portions such as wings or stabilizing fins or to be struck glancing blows by other parts of the missile or nose cone, in which latter case the impact shocks will be less than that caused by a direct hit. In the former case, although the impact shock may be as great, or nearly as great, as that of a direct target hit by the nose cone impact portion, impact discrimination is made possible by discriminating between directions of impact shock wave propagation, as hereinafter described.

Figure 1:
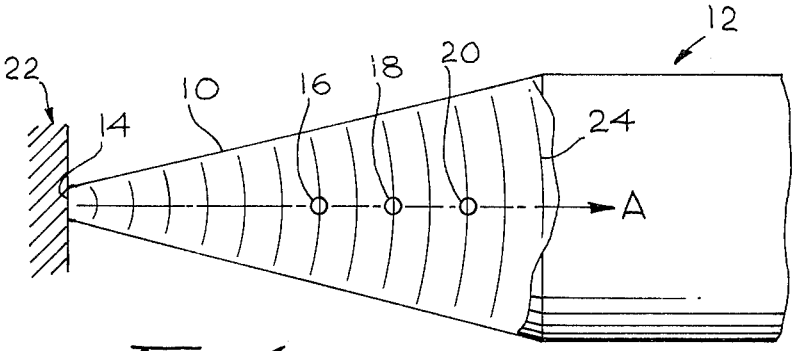
FIG. 1 is a vertical sectional view, showing positioning of the impact sensors and showing the shock wave caused by a direct impact.

As best seen in FIG. 1, directional impact discrimination is provided by a plurality of impact sensors disposed in spaced relationship along a longitudinal axis of a nose cone 10 of a missile 12. Three sensors 16, 18 and 20 are shown positioned near, and rearwardly of, an impact portion 14. As few as two sensors, or more than the three shown, may be employed. The sensors 16 to 20, which may be conventional accelerometers or spring-mass switches, are arranged with the first sensor 16 relatively adjacent to the impact portion 14. Spaced somewhat rearwardly from the first sensor 16 is the second sensor 18, and somewhat rearwardly therefrom is the third sensor 20. Preferably, and largely for convenience, the spacing between the sensors 16 and 18 is made equal to that between the sensors 18 and 20.

When the nose cone impact portion 14 directly impacts against a solid object 22, it is apparent that a shock wave will propagate rearwardly along the axis of the missile 12, in the direction of arrow A, a shock front 24 successively passing the sensors 16, 18 and 20, in that order. There will be a finite time interval between the times the shock front 81 24 passes the first sensor 16 and the second sensor 18, and another finite time interval before it then passes the sensor 20. Conversely, if, for example, a solid object 28 is struck by a projecting tail fin 30 (FIG. 2), the resulting shock wave propagates forwardly along the longitudinal axis of the missile 12 in a direction of arrow B. A resulting shock front 32 consequently passes the sensors 16 to 20 in reverse order, passing the third sensor 20 first and the first sensor 16 last.

Figure 3:
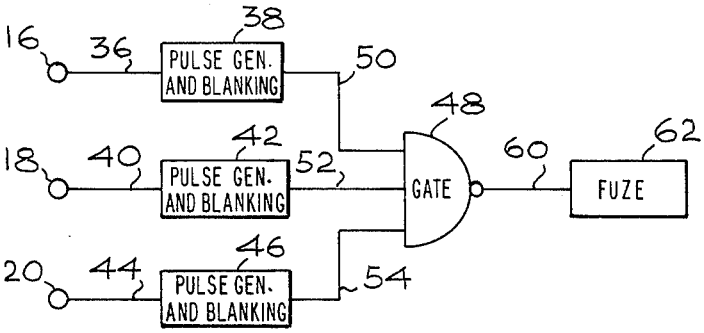
FIG. 3 is a schemtic block drawing of the impact discriminating circuitry.

The possible different directions of shock wave propagation thus allow for impact discrimination to prevent unintended warhead fusing or detonation. As seen in FIG. 3, the output of the first sensor 16 is connected, via an electrical line 36, to a first pulse generator and blanking circuit 38. Similarly, the output of the second sensor 18 is connected, via a line 40, to a second pulse generator and blanking circuit 42 and the output of the third sensor 20 is connected, via a line 44, to a third pulse generator and blanking circuit 46. The pulse generating and blanking circuits 38, 42 and 46 are more particularly described below.

Output signals from the circuits 38, 42 and 46, responsive to input signals from the sensors 16–20, are fed to separate inputs of a gate 48, by lines 50, 52 and 54, respectively. The resultant output of the gate 48, which may be a conventional NAND gate, is fed, via a line 60, to a conventional warhead fusing or detonating element 62.

Figure 4:
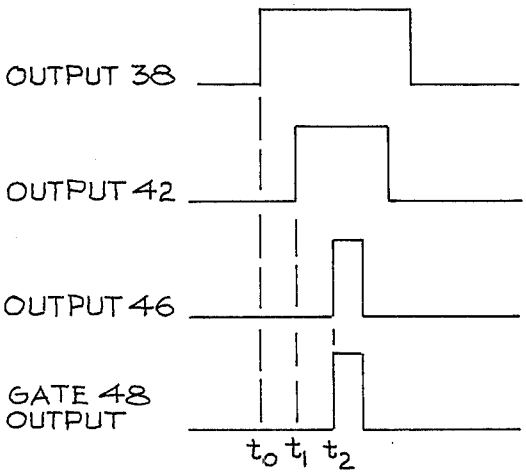
FIG. 4 is a diagram showing discriminator output pulses for an impact wave caused by a direct impact.

When the shock front 24 (FIG. 1) of the shock wave, propagated in the direction of arrow A, passes the first sensor 16, the resultant sensor output is transmitted along the line 36 to the conventional pulse generator portion of circuit 38 which causes an output pulse indicated as "output 38" in FIG. 4. Similarly, when the shock front 24 passes the second sensor 18, the circuit 42 causes an output pulse indicated as "output 42". The circuit 46 causes a pulse indicated as "output 46" when the shock front passes the third sensor 20. Pulse generating portions of the circuits 38, 42, and 46 thus respectively initiate output pulses at times $t_0$, $t_1$, and $t_2$, corresponding to the passing of the shock front 24 past the sensors 16, 18 and 20. However, for reasons which will become apparent, the pulses generated by the circuits 38, 42 and 46 are caused to be of unequal length, through conventional pulse width adjustment methods. The length of the first circuit 38 pulse (associated with the sensor 16 located closest to the impact portion 14) is caused to be the longest and that of the third circuit 46 (associated with the sensor 20 located farthest from the impact portion) is caused to be the shortest, so that, for a rearwardly propagating wave front 24 (FIG. 1), the pulse from the circuit 46 returns to its initial level slightly before (or at least at about the same time) as do the pulses from both the circuits 42 and 38. Stated otherwise, although the pulses from the circuits 38, 42 and 46 initiate at successively later points in time for a rearwardly directed shock wave, they all end at about the same time.

At the point in time ($t_2$ in FIG. 4) when the pulses from the three circuits 38, 42 and 46 first coincide or start to overlap, the gate 48, which is shown as a NAND gate, is gated on and a triggering signal is fed, via the line 60, to the conventional fusing or detonating circuit 62, thereby causing fusing or detonation of the missile warhead.

Figure 2:
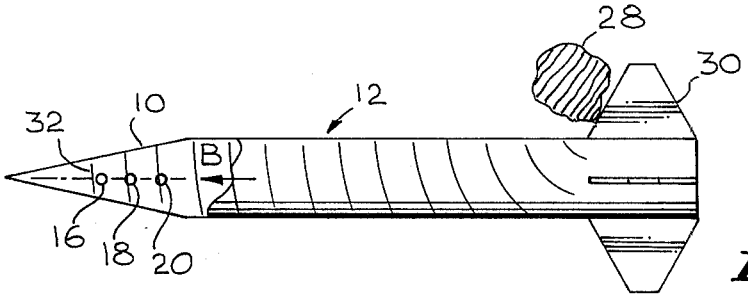
FIG. 2 is a partial cutaway view, showing positioning of the impact sensors and showing an impact wave caused by a missile fin striking a non-target object.
Figure 5:
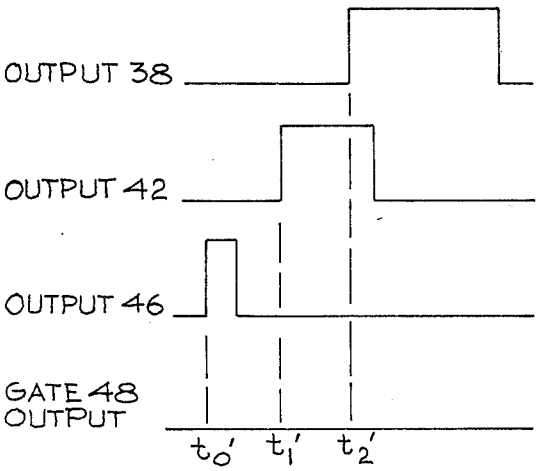
FIG. 5 is a diagram showing discriminator pulses for an impact wave caused by the condition of FIG. 2.

In contrast, pulse sequencing for a forwardly propagated shock front 32, corresponding to FIG. 2, is illustrated in FIG. 5. As previously noted, the shock front 32 passes the sensors in the reverse sequence 20, 18 and 16. This progression causes the output of the circuits 38, 42 and 46 to be non-coincident and nonoverlapping, the pulse from circuit 46, for example, being initiated at the time $t_0'$ and returning to its initial level before the pulse from the circuit 42 is initiated at time $t_1'$ and before the pulse from the circuit 38 is initiated at time $t_2'$. Consequently, there is no point in time when pulses from all three circuits 38, 42 and 46 are coincident or overlap; hence, there is no triggering signal from the gate 48 to the fusing or detonating circuit 62. It will be appreciated, however, that if the widths of the pulses from each of the three circuits 38, 42 and 46 were the same, and of a width sufficient to cause overlapping for the rearwardly propagating shock front 24 (FIG. 1), pulse overlapping would also occur for the forwardly propagated shock front 32, and fusing or detonation would result in both cases.

Associated with the forwardly propagating shock front 32 (FIG. 2) is a rearwardly reflected shock wave (not shown) caused when the shock front 32 hits the front of the nose cone 10. If this reflected wave is sufficiently strong, as it may be, it will look to the sensors 16 to 20, and they will respond to it, as if it were an initial, rearwardly propagated shock wave like the shock wave 24 (FIG. 1). Unintentional warhead fusing or detonation would then occur if no provision were made for rejecting, blanking out or otherwise disregarding the effect of this reflected wave.

To this end, the circuits 38, 42 and 46 also provide signal blanking by conventional electronic means, whereby a second output pulse is prevented during a period of time greater than that required for a forwardly propagated shock wave to reach the forward end of the nose cone from the sensors 16 to 20 and for its reflected wave to propagate rearwardly back past the sensors. That is, although the sensors 16 to 20 also respond to the rearwardly reflected shock wave, and therefore feed output signals to the circuits 38, 42 and 46, the blanking portions of such circuits either reject these output signals from the sensors (which closely follow the output signals caused by the original, forwardly propagated shock wave), or inhibit pulse generator output for a predetermined time after the initial pulse are generated. As a result, the outputs of the circuits 38, 42 and 46 show the effect of the forwardly propagated wave front 32 (FIG. 5), but not of the reflected wave caused thereby, and the fusing or detonating circuit 62 is not triggered.

In the above-described manner, warhead fusing or detonation occurs as the results of a rearwardly traveling impact shock front wave, but not as a result of a forwardly traveling shock front or a reflected shock wave caused thereby.

It is to be appreciated that the widths of the pulses from the circuits 38, 42 and 46 depend upon the spacing between the sensors 16, 18 and 20 and the shock front propagation velocity within the sensor-mounted portion of the missile, the requirement being the causing of pulse generator output signal overlapping for rearwardly traveling shock fronts but not for forwardly traveling shock fronts. The blanking time for blanking the effect of reflected waves depends upon the position of the sensors 16 to 20 relative to the forward end of the missile, and the shock front propagation velocity within the missile, the requirement being that effects of a rearwardly reflected shock wave are blanked out.

Additionally, pulse height or sensor signal strength discrimination is preferably provided, in a conventional manner, within the circuits 38, 42 and 46 and the gate 48 so that there is no gate output pulse, and hence no fusing or detonation, for impact shocks below a predetermined impact level. Such additional discrimination, for example, prevents unintended missile fusing or detonation from a low impact direct hit by the impact portion 14 against light objects such as small branches, foliage, rain, etc., and from low impact glancing impacts on sides of the nose cone 10 or on other parts of the missile 12, both of which types of impact might otherwise cause overlapping of the pulses from the circuits 38, 42 and 46 and detonation or fusing of the warhead. This is possible since such impacts will normally be of substantially lesser magnitude than a direct and higher level impact by the nose cone impact portion 14 against an intended target.

A corresponding method for directional impact discrimination upon missiles and the like is thereby provided.

It will be appreciated that by use of more complex arrangements of sensors, not all of which need be disposed along any one direction or the longitudinal axis of the missile, such as is shown in FIG. 1, any degree of desired impact discrimination may be provided. It will also be appreciated that impact discrimination means as has been described herein is adaptable for controlling operation of impact responsive function performing means in other types of moving or movable objects. As an example, such apparatus could be used in automobiles to cause deployment of a safety air bag only upon frontal automobile impact of a predetermined magnitude.

Thus, although there have been described hereinabove specific arrangements of an impact discriminating apparatus and method for impact discrimination, in accordance with the invention, for the purpose of illustrating the manner in which the invention may be used to advantage, it is to be understood that the invention is not limited thereto. Accordingly, any and all modifications, variations or equivalent arrangements which may occur to those skilled in the art should be considered to be within the scope of the invention as defined in the appended claims.

What is claimed is:

1. In combination with a movable object having impact responsive function performing means, impact discriminating means for controlling said function performing means, which comprises:

a. a plurality of impact sensors disposed within said object in spaced relationship generally along a predetermined line of Impact,
said sensors having electrical output signals responsive to impact shocks received by said sensors, and b. electronic comparing means cooperating with said sensors and said function performing means for comparing said sensor output signals and for causing operation of said function performing means only when said sensor output signals indicate occurrence of an impact in a predetermined direction along said predetermined line of impact.

2. The invention as claimed in claim 1, wherein said comparing means includes pulse height discrimination means for rejecting said sensor output signals which are below a predetermined level, whereby effects of impacts below a predetermined impact level are blanked out.

3. The invention as claimed in claim 1, wherein said comparing means includes pulse generating means associated with each of said sensors for separately receiving said output signals therefrom, and for causing pulse generator output pulses having predetermined pulse widths associated with each of said sensors.

4. The invention as claimed in claim 3, wherein said pulse generating means includes blanking means for blanking out effects of subsequent output signals received from said sensors which occur within a predetermined time after first output signals are received therefrom, whereby effects of shock waves rearwardly reflected from said impact region along said predetermined line of impact are blanked out.

5. The invention as claimed in claim 3, wherein each of said sensors has associated therewith a different pulse generator pulse width, said pulse width varying according to the position of said sensors along said predetermined line of impact, said pulse width associated with sensors close to a predetermined impact region being longer than said pulse widths associated with sensors more remote from said impact region, said pulse widths being sufficient to cause overlapping of pulses from a preselected number of said pulse generating means when a shock wave is propagated in said predetermined direction along said predetermined line of impact, and being insufficient to cause overlapping of pulses from said preselected number of said pulse generating means when a shock wave is propagated in a direction opposite to said predetermined direction.

6. The invention as claimed in claim 5, wherein said comparing means includes gating means having inputs connected to said pulse generating means and having an output connected to said function performing means, the output of said gating means being initially in a first state and being caused to change to a second state to operate said function performing means when, and only when, said overlapping pulses from said preselected number of said pulse generating means are received by said inputs.

7. In a missile having fusing or detonating means, impact discriminating means for operating said fusing or detonating means, which comprises:

a. a plurality of impact sensors arranged in spaced relationship along a predetermined line of impact and comparatively adjacent to a predetermined impacting point,
said sensors having electrical output signals responsive to impact shocks received by said sensors, b. pulse generating means electrically connected to said sensors for receiving electrical signals from said sensors in response to impact shock waves sensed thereby,
said pulse generating means including pulse generators associated with each of said sensors, for converting electrical outputs therefrom into generator output pulses having predetermined pulse widths varying with the position of an associated sensor along said line of impact, said predetermined pulse widths decreasing with increasing distances of said associated sensors from said impacting point and being such that a shock wave propagating rearwardly from said impacting point through said missile and along said predetermined line of impact causes overlapping of said pulses, but a shock wave propagated forwardly through said missile, along said predetermined line of impact towards said impacting point does not cause overlapping of said pulses, and c. gating means for causing operation of said fusing or detonating means, said gating means having inputs into which are directed said generator output pulses, and having an output initially in a first state not causing operating of said fusing or detonating means,
said output being caused to change to a second state operating said fusing or detonating means only when generator output pulses received from each of said pulse generators are in an overlapping relationship, whereby operation of said fusing and detonating means is caused by a shock wave propagating rearwardly through said missile along said predetermined line of impact from said impacting point, but not by a shock wave traveling in the opposite direction.

8. The invention as claimed in claim 7, including blanking means for causing disregarding of second output signals from said sensors received within a predetermined time after first output signals are received therefrom, whereby effects of shock waves rearwardly reflected from said impact point, and caused by shock waves traveling forwardly along said predetermined line of impact, are disregarded.

9. The invention as claimed in claim 7, including pulse height discriminating means for causing said sensor electrical outputs associated with impact shocks below a predetermined level to be disregarded, regardless of direction of propagation of the resulting shock waves, whereby said fusing or detonating means may be operated only by impact shocks above said predetermined shock level.

10. A method for impact shock discrimination, which comprises the steps of:

a. arranging, within a movable object, a plurality of impact shock sensors in spaced relationship generally along a preselected line of impact, said sensors having output signals responsive to shock waves sensed thereby, b. converting said output signals from each of said sensors into pulses, c. causing widths of said pulses to vary in direct relationship with spacing of associated sensors from a preselected point of impact, whereby a shock wave propagated along said line of impact rearwardly through said object from said impact point causes an overlapping of said pulses and whereby a shock wave propagated forwardly through said object along said line of impact toward said impact point does not cause overlapping of said pulses, and d. feeding said pulses into a discriminating element which discriminates between overlapping pulses and non-overlapping pulses, whereby directional discrimination of shock wave propagation is provided.

11. The method as claimed in claim 10, including the step of blanking out effects of second electrical output signals received from said sensors within a predetermined time after first output signals are received therefrom, whereby effects of reflected shock waves are disregarded.

12. The method as claimed in claim 10, including the step of disregarding electrical output signals from said sensors which have a magnitude below a predetermined level, whereby the effects of impact shock below a predetermined level are disregarded, regardless of the direction of propagation of the resulting impact shock wave.

13. The method as claimed in claim 10, including the step of operating a function performing means only when said overlapping pulses are received by said discriminating element.

* * * * *